United States Patent [19]

Brinegar et al.

[11] Patent Number: 4,684,505

[45] Date of Patent: Aug. 4, 1987

[54] HEAT RESISTANT ALLOYS WITH LOW STRATEGIC ALLOY CONTENT

[75] Inventors: John R. Brinegar, N. Muskegon, Mich.; William R. Freeman, Easton, Conn.

[73] Assignee: Howmet Turbine Components Corporation, Greenwich, Conn.

[21] Appl. No.: 743,485

[22] Filed: Jun. 11, 1985

[51] Int. Cl.[4] ..... C22C 38/06

[52] U.S. Cl. ..... 420/81; 420/124; 420/126

[58] Field of Search ..... 75/124 F, 124 R, 123 J, 75/123 M, 126 D, 128 T; 420/81, 126, 124

[56] References Cited

U.S. PATENT DOCUMENTS

| | | | |
|---|---|---|---|
| 1,990,650 | 2/1935 | Jaeger | 75/124 R |
| 2,726,952 | 12/1955 | Morgan | 75/124 R |
| 3,193,384 | 7/1965 | Richardson | 75/124 R |
| 3,582,323 | 6/1971 | Sawyer et al. | 75/124 R |
| 3,992,161 | 11/1976 | Cairns et al. | 75/124 |
| 4,018,569 | 4/1977 | Chang | 75/124 |
| 4,214,042 | 7/1980 | Wilson | 75/124 |
| 4,402,745 | 9/1983 | Ray et al. | 75/124 R |

FOREIGN PATENT DOCUMENTS

| | | | |
|---|---|---|---|
| 53-119721 | 10/1978 | Japan | 75/124 |
| 174443 | 1/1922 | United Kingdom . | |
| 810077 | 3/1959 | United Kingdom . | |

OTHER PUBLICATIONS

E. R. Morgan and V. F. Zackay, "Ductile Iron-Aluminum Alloys", *Metal Progress*, vol. 68, Oct. 1955, pp. 126-128.

J. F. Nachman and W. J. Buehler, "16 Percent Aluminum-Iron Alloy Cold Rolled in the Order-Disorder Temperature Range", *J. Appl. Phys.*, vol. 25, No. 3, Mar. 1954, pp. 307-313.

L. I. Lysak et al., "Atomic Ordering and Carbide Formation In Quenched Iron-Aluminum-Carbon Alloys During Heating," *Fiz. Met Metalloved*, vol. 35, No. 6, 1973, pp. 153-157.

J. Y. Guedou et al., "Short Memory Effect and Pseudoelasticity in Fe-Al Alloys, (Citation unknown).

S. M. Arora et al., "Development of Iron-Aluminum Alloys," *Transactions of the Indian Institute of Metals*, Dec. 1966, pp. 195-201.

S. Hanada, et al. "Deformation of $Fe_3Al$ Single Crystals at Room Temperatures," *Scripta Metallurgica* vol. 15 (1981) pp. 1345-1348.

A. R. Cox, "Application of RSR Powder Metals to Vehicular Gas Turbine Engines," (Citation unknown).

J. S. Andrus, et al., "Development of Iron Aluminides," *Interim Technical Report FR-18163*, Contract No. F33615-81-C-5110 Materials Laboratory, Air Force Wright Aeronautical Laboratories, Wright-Patterson Air Force Base, Ohio, May 1984.

*Primary Examiner*—L. Dewayne Rutledge
*Assistant Examiner*—Deborah Yee
*Attorney, Agent, or Firm*—Finnegan, Henderson, Farabow, Garrett & Dunner

[57] ABSTRACT

A high temperature alloy displaying excellent elevated temperature properties as well as low strategic metals content. Based on the iron/aluminum system, the alloy contains about 10 to 19% aluminum, 2 to 8% titanium, from about 0.5 to 10% molybdenium, from 0.1 to 1% hafnium and the balance substantially iron.

6 Claims, 3 Drawing Figures

FIG. 1

Page 2

TABLE I

CHEMISTRIES OF IRON-ALUMINUM ALLOY (Values are WT % except of $O_2$ and $N_2$ which are in PPM)

| Alloy Code | ALLOY COMPOSITION AL | HF | MO | SI | TI | +X | AL | HF | MO | SI | TI | C | B | TA | NI | CR | CB | V | W | CO | MN | ZR | S | P | $O_2$ | $N_2$ |
|---|---|---|---|---|---|---|---|---|---|---|---|---|---|---|---|---|---|---|---|---|---|---|---|---|---|---|
| 34 | 17, | .5, | 8, | 0, | 8 | | 17.30 | 0.54 | 8.40 | <.01 | 8.40 | 0.010 | NA | 0.09 | 0.02 | <.01 | 0.17 | 0.09 | 0.17 | 0.53 | <.01 | 0.017 | 0.0013 | 0.02 | 44 | 6 |
| 35 | 17, | .2, | 9, | 0, | 8 | | 17.10 | 0.20 | 8.64 | <.01 | 8.00 | 0.010 | NA | 0.08 | 0.02 | <.01 | 0.17 | 0.08 | 0.16 | 0.10 | <.01 | 0.015 | 0.0016 | 0.03 | 3 | 47 |
| 36 | 11, | .7, | 8, | 0, | 7 | | 10.75 | 0.69 | 7.65 | -- | 6.50 | 0.041 | 0.0083 | 0.11 | 0.10 | -- | 0.09 | 0.11 | -- | -- | 0.14 | 0.075 | 0.0090 | 0.23 | 646 | 12 |
| 37 | 12, | 1, | 8, | 0, | 6 | | 11.65 | 1.00 | 7.93 | -- | 5.95 | 0.008 | 0.0100 | 0.09 | -- | -- | 0.10 | 0.09 | -- | 0.07 | 0.11 | 0.085 | 0.0061 | 0.29 | 25 | 8 |
| 38 | 17, | .7, | 9, | 0, | 9 | +.1C | 16.50 | 0.68 | 8.60 | NA | 8.50 | 0.060 | NA | 0.09 | 0.01 | <.01 | 0.17 | 0.09 | 0.15 | 0.10 | 0.01 | 0.022 | 0.0026 | 0.03 | 4 | 22 |
| 39 | 14, | .2, | 3, | 0, | 8 | | 14.40 | 0.24 | 3.10 | -- | 7.93 | 0.028 | 0.0080 | 0.09 | 0.12 | 0.10 | 0.08 | 0.09 | -- | 0.07 | 0.12 | -- | 0.0043 | 0.21 | 35 | 13 |
| 40 | 14, | .3, | 8, | 0, | 2 | | 13.80 | 0.31 | 8.37 | -- | 1.89 | 0.022 | 0.0084 | -- | -- | -- | 0.07 | -- | -- | -- | 0.17 | 0.061 | 0.0006 | 0.02 | 564 | 24 |
| 41 | 14, | 1, | 10, | 0, | 2 | | 13.60 | 0.95 | 10.20 | -- | 1.90 | 0.009 | 0.0100 | 0.23 | 0.12 | 0.17 | 0.08 | 0.23 | -- | -- | 0.15 | 0.089 | 0.0043 | 0.03 | 30 | 8 |
| 42 | 17, | 2, | 8, | .1, | 8 | | 16.70 | 1.60 | 8.44 | 0.14 | 8.10 | 0.030 | NA | 0.09 | 0.01 | <.01 | 0.17 | 0.09 | 0.15 | 0.09 | <.01 | 0.035 | 0.0027 | 0.02 | 6 | 88 |
| 43 | 15, | 0, | 0, | .3, | 0 | | 14.80 | 0.08 | 0.50 | 0.33 | -- | 0.004 | 0.0180 | -- | 1.22 | 0.47 | -- | -- | 0.10 | 0.18 | -- | -- | 0.0006 | 0.18 | 1 | 12 |
| 44 | 14, | 0, | 0, | 4, | 0 | | 14.35 | 0.06 | 0.15 | 3.50 | -- | 0.009 | 0.0200 | -- | 1.28 | 0.55 | -- | -- | 0.09 | 0.19 | -- | -- | 0.0007 | 0.17 | 142 | <1 |
| 45 | 13, | .6, | 5, | 2, | 4 | | 13.00 | 0.62 | 4.70 | 1.98 | 4.41 | 0.030 | NA | 0.05 | 0.01 | <.01 | 0.13 | 0.05 | 0.16 | 0.10 | <.01 | 0.031 | 0.0009 | 0.02 | 5 | 24 |
| 46 | 12, | .2, | 5, | 4, | 4 | | 12.40 | 0.24 | 4.45 | 3.60 | 4.30 | 0.010 | NA | 0.04 | 0.04 | <.01 | 0.15 | 0.04 | 0.17 | 0.10 | <.01 | 0.011 | 0.0024 | 0.02 | 4 | 9 |
| 47 | 28, | .5, | 4, | 1, | 4 | | 28.00 | 0.46 | 3.92 | 1.40 | 3.60 | 0.020 | 0.0110 | 0.08 | -- | -- | 0.07 | 0.08 | 0.08 | 0.22 | -- | -- | <.0001 | NA | 10 | 4 |
| 48 | 19, | .5, | 4, | 2, | 4 | | 19.40 | 0.46 | 3.80 | 2.00 | 3.80 | 0.010 | 0.0080 | -- | -- | -- | 0.06 | -- | -- | -- | -- | 0.100 | <.0001 | NA | 11 | 3 |
| 49 | 16, | .2, | 4, | .5, | 8 | +.1C | 16.20 | 0.20 | 4.31 | 0.53 | 7.75 | 0.070 | NA | 0.08 | 0.03 | <.01 | 0.14 | 0.08 | 0.18 | 0.10 | <.01 | 0.007 | 0.0017 | 0.02 | 8 | 600 |
| 50 | 15, | .5, | 4, | .3, | 4 | +.2C | 15.00 | 0.46 | 3.66 | 0.26 | 3.70 | 0.150 | 0.070 | -- | -- | -- | 0.06 | -- | -- | -- | 0.11 | -- | 0.0004 | NA | 12 | 6 |
| 51 | 16, | .5, | 4, | 3, | 4 | +.2C | | | | | | | | | | | | | | | | | | | | |
| 52 | 14, | .4, | 8, | 0, | 8 | | | | | | | | | | | | | | | | | | | | | |
| 53 | 14, | 0, | 8, | 0, | 8 | | | | | | | | | | | | | | | | | | | | | |
| 54 | 12, | .4, | 8, | 0, | 8 | | | | | | | | | | | | | | | | | | | | | |
| 55 | 14, | .4, | 6, | 0, | 3 | | | | | | | | | | | | | | | | | | | | | |
| 56 | 12, | .4, | 6, | 2, | 3 | | | | | | | | | | | | | | | | | | | | | |
| 57 | 11, | .4, | 6, | 3, | 3 | | | | | | | | | | | | | | | | | | | | | |
| 58 | 14, | .4, | 8, | 0, | 4 | | | | | | | | | | | | | | | | | | | | | |
| 59 | 12, | .4, | 8, | 2, | 4 | | | | | | | | | | | | | | | | | | | | | |
| 60 | 11, | .4, | 8, | 3, | 4 | | | | | | | | | | | | | | | | | | | | | |
| 61 | 14, | .4, | 4, | 0, | 4 | | | | | | | | | | | | | | | | | | | | | |
| 62 | 2, | .4, | 4, | 2, | 8 | | | | | | | | | | | | | | | | | | | | | |
| 63 | 11, | .4, | 4, | 3, | 8 | | | | | | | | | | | | | | | | | | | | | |

FIG. 2

TABLE II

STRESS RUPTURE TESTING OF IRON-ALUMINUM ALLOY

| Alloy No. | Alloy Composition | Temp. (1of1) | Stress (KSI) | Life (Hrs.) | Elong. (%) | RofA (%) | Cond.(1) |
|---|---|---|---|---|---|---|---|
| 8 | 16, 0, 0, 0, 4 +.1C | 1200 | 35.0 | 6.6 | 10.8 | 30.1 | AC |
| 5 | 16, 0, 0, 0, 5 | 1200 | 35.0 | 31.7 | 3.7 | 8.0 | AC |
| 8 | 16, 0, 0, 0, 4 +.1C | 1200 | 40.0 | 3.4 | 18.2 | 29.3 | AC |
| 8 | 16, 0, 0, 0, 4 +.1C | 1200 | 40.0 | 8.4 | 14.2 | 26.6 | AC |
| 5 | 16, 0, 0, 0, 5 | 1200 | 40.0 | 15.2 | 7.0 | 5.7 | AC |
| 12 | 15,.6, 4, 0, 0 | 1200 | 35.0 | 8.9 | 5.4 | 48.0 | AC |
| 18 | 14,.5, 1, 0, 4 | 1200 | 35.0 | 257.9 | 3.4 | 14.9 | AC |
| 15 | 14,.5, 3, 0, 0 +.2C | 1200 | 40.0 | .1 | 27.0 | 66.0 | AC |
| 12 | 15,.6, 4, 0, 0 | 1200 | 40.0 | 1.3 | 12.7 | 52.6 | AC |
| 18 | 15, 1, 4, 0, 0 | 1200 | 40.0 | 2.3 | 14.4 | 53.4 | AC |
| 16 | 14,.5, 0, 0, 3 +.1C | 1200 | 40.0 | 5.1 | 14.7 | 45.5 | AC |
| 14 | 14,.6, 0, 0, 4 +.1C | 1200 | 40.0 | 15.4 | 34.7 | 58.6 | HIP/1650 |
| 14 | 14,.6, 0, 0, 4 +.1C | 1200 | 40.0 | 20.4 | 13.0 | 40.5 | AC |
| 18 | 14,.5, 1, 0, 4 | 1200 | 40.0 | 23.3 | 28.5 | 49.5 | HIP/1650 |
| 18 | 14,.5, 1, 0, 4 | 1200 | 40.0 | 81.8 | 3.0 | 5.6 | AC |
| 18 | 14,.5, 1, 0, 4 | 1200 | 45.0 | 34.4 | 1.9 | 6.3 | AC |
| 13 | 15, 1, 4, 0, 0 | 1200 | 50.0 | .1 | 16.9 | 40.3 | AC |
| 17 | 15,.5, 0, 0, 4 | 1200 | 50.0 | 41.1 | 10.1 | 25.8 | AC |
| 24 | 14,.5, 4, 0, 4 +.1C | 1200 | 40.0 | 24.5 | 30.5 | 31.2 | HIP/1650 |
| 24 | 14,.5, 4, 0, 4 +.1C | 1200 | 40.0 | 24.7 | 12.1 | 20.0 | AC |
| 22 | 15,.3, 2, 0, 2 | 1200 | 40.0 | 27.6 | 19.5 | 57.2 | AC |
| 19 | 14,.6, 4, 0, 4 | 1200 | 40.0 | 294.4 | 5.3 | 15.6 | AC |
| 23 | 14,.6, 4, 0, 5 | 1200 | 40.0 | 661.6 | 1.2 | 2.4 | AC |
| 19 | 14,.6, 4, 0, 4 | 1200 | 45.0 | 98.8 | 3.4 | 11.0 | AC |
| 23 | 14,.6, 4, 0, 5 | 1200 | 45.0 | 191.2 | | | AC |
| 19 | 14,.6, 4, 0, 4 | 1200 | 50.0 | 32.0 | 5.4 | 19.2 | AC |
| 25 | 17,.3, 4, 0, 4 | 1200 | 50.0 | 45.9 | 7.2 | 20.7 | AC |
| 40 | 14,.3, 8, 0, 2 | 1200 | 40.0 | 83.7 | 8.6 | 21.5 | AC |
| 41 | 14, 1,10, 0, 2 | 1200 | 40.0 | 277.9 | 17.2 | 51.1 | AC |
| 36 | 11,.7, 8, 0, 7 | 1200 | 40.0 | 311.1 | 3.4 | 7.2 | AC |
| 30 | 14,.2, 3, 0, 8 | 1200 | 40.0 | 468.3 | 1.7 | 2.4 | AC |
| 30 | 14,.2, 3, 0, 8 | 1200 | 40.0 | 709.5 | 1.4 | | HIP |
| 28 | 13,.3, 8, 0, 8 | 1200 | 40.0 | 1111.0 | 1.4 | | AC |
| 41 | 14, 1,10, 0, 2 | 1200 | 45.0 | 7.3 | 1.1 | 1.6 | AC |
| 36 | 11,.7, 8, 0, 7 | 1200 | 45.0 | 16.9 | | | AC |
| 39 | 11,.1, 7, 0, 7 | 1200 | 45.0 | 99.3 | 10.4 | 22.7 | HT |
| 29 | 11,.1, 7, 0, 7 | 1200 | 45.0 | 111.3 | 1.3 | 1.6 | AC |
| 21 | 12,.2, 7, 0, 8 | 1200 | 45.0 | 192.3 | 1.7 | | AC |
| 21 | 12,.2, 7, 0, 8 | 1200 | 50.0 | 58.7 | 2.6 | 1.6 | AC |
| 31 | 12,.2, 7, 0, 8 | 1400 | 50.0 | .4 | 1.2 | | AC |
| 43 | 14, 0, 0, 4, 0 | 1200 | 40.0 | 27.2 | 14.9 | 29.2 | AC |
| 50 | 15,.5, 4,.3, 4 +.2C | 1200 | 40.0 | 338.3 | 12.7 | 19.7 | AC |
| 50 | 15,.5, 4,.3, 4 +.2C | 1200 | 50.0 | 90.5 | 7.4 | 15.4 | AC |
| 51 | 16,.5, 4,.3, 4 +.2C | 1200 | 50.0 | 250.0 | | | AC |

Notes: (1.) - AC - as cast.

HEAT RESISTANT ALLOYS WITH LOW STRATEGIC ALLOY CONTENT

FIELD OF INVENTION

The present invention relates to heat resistant alloys and, more particularly, to an iron-aluminum alloy composition including aluminum, hafnium, titanium, molybdenum, silicon, and carbon as the major alloying elements.

BACKGROUND OF THE INVENTION

Recently the availability of strategic elements such as chromium, columbium, tantalum, and cobalt has been reduced for a variety of economic reasons. The reduced availability of these strategic elements is of great concern to the aerospace industry as these elements are essential to the production of modern aircraft gas turbine engines. The threat of loss of supply of these elements has necessitated consideration of alternatives to existing nickel-base superalloys which generally include substantial additions of strategic elements.

One such alternative is iron-base alloys and, specifically, iron-aluminium alloys. Iron aluminides offer great potential for high corrosion and oxidation resistance, low cost, low weight, and low strategic metal content. Of particular interest are the very good density-compensated mechanical properties. However, previous research on iron-15% aluminum (16 Alfenol), iron-16% aluminum-3.5% molybdenum-0.1% lanthanum (Thermenol) and iron-8/14% aluminum-3% titanium alloys has indicated that alloys based on the iron-aluminum system lack ductility to such a degree that they can neither be fabricated satisfactorily nor utilized because of brittleness. These percentages, as well as those elsewhere used in this description, are in terms of weight percent.

In general, at least 8% aluminum content is required for adequate oxidation resistance. At the time of earlier investigations in iron-aluminum systems, it was expected that over 5% aluminum content would embrittle the alloy. However, improvements at that time in melting and refining practice yielded lower oxygen contents and ductility was improved for iron-aluminum alloys with up to 12% aluminum content.

Ultimately, however, lack of ductility at low temperatures and poor hot workability discouraged investigators. Recently, several technologies including directionally solidified/single crystal castings and rapidly solidified powders have emerged which could improve the shortcomings of the iron-aluminum alloy system. Single crystal castings eliminate grain boundary contributions to poor ductility and increase rupture strength. Rapidly solidified powder (RSP) technology provides extended solid solubility limits, homogeneous microcrystalline structures, and greatly refined grain size which would be expected to improve low temperature ductility, but in many instances at some sacrifice to creep strength.

One currently accepted approach to the development of iron-aluminum alloys is to produce rapidly solidified powders of appropriate compositions which are consolidated by vacuum canning and extrusion. After thermal treatments, the alloys are analyzed for the properties of interest. This procedure is costly and time consuming and such goals could also be achieved by employing investment casting of a large number of experimental compositions for which the desired high temperature properties could be readily determined. Once promising compositions are identified, other desirable properties can be determined by processing a few selected compositions by powder metallurgy (P/M) techniques to demonstrate particularly the ability to achieve a ductile material at low temperature.

In the past, and currently, investigators have sought to develop iron-aluminum alloys for low strength, high temperature (1800° F.) applications and for high strength, low temperature (600° F.) applications. Applications such as high pressure compressor and low pressure turbine blade vanes and other components require adequate creep rupture properties at about 1200° F. Traditionally low pressure turbine blades employ nickel-base or cobalt-base superalloys primarily because of the creep resistance requirements in the 1200° F. range. Consequently, an iron-aluminum alloy composition having elevated temperature strength approaching conventional superalloys with adequate low temperature ductility would be desirable.

Accordingly, it is an object of the invention to provide an iron-aluminum alloy composition having excellent oxidation resistance and creep rupture properties as an alternative to conventional nickel-base and cobalt-base superalloys for elevated temperature applications.

Another objective of the invention is to provide a material for high temperature applications having a high density-compensated strength.

It is a further objective of the invention to provide an iron-aluminum alloy composition having strengths at 1200° F. approximating the strengths of conventional heat resistant alloys such as A286 and X40.

A still further object of the invention is to provide an iron-aluminum alloy composition having suitable ductility at low temperatures.

Additional objects and advantages will be set forth in part in the description which follows, and in part, will be obvious from the description, or may be learned by practice of the invention.

SUMMARY OF THE INVENTION

To achieve the foregoing objects and in accordance with the purpose of the invention, as embodied and broadly described herein, the iron-aluminum alloy composition of the present invention includes from 10 to about 22% aluminum, from about 2 to about 12% titanium, from about 2 to about 12% molybdenum, from about 0.1 to about 1.2% hafnium, up to about 1.5% silicon, up to about 0.3% carbon, up to about 0.2% boron, up to about 1.0% tantalum, up to about 0.5% tungsten, up to about 0.5% vanadium, up to about 0.5% manganese, up to about 0.3% cobalt, up to about 0.3% columbium, up to about 0.2% lanthanum, and the balance substantially iron.

Preferably, the iron-aluminum alloy composition includes from about 10 to about 19% aluminum, from about 2 to about 8% titanium, from about 0.5 to about 10% molybdenum, from about 0.1 to about 1% hafnium, and the balance substantially iron.

BRIEF DESCRIPTION OF THE DRAWINGS

FIG. 1 is a table (Table I) of compositions.

FIG. 2 is a table (Table II) of compositions and properties.

DESCRIPTION OF THE PREFERRED EMBODIMENTS

Figure 3:
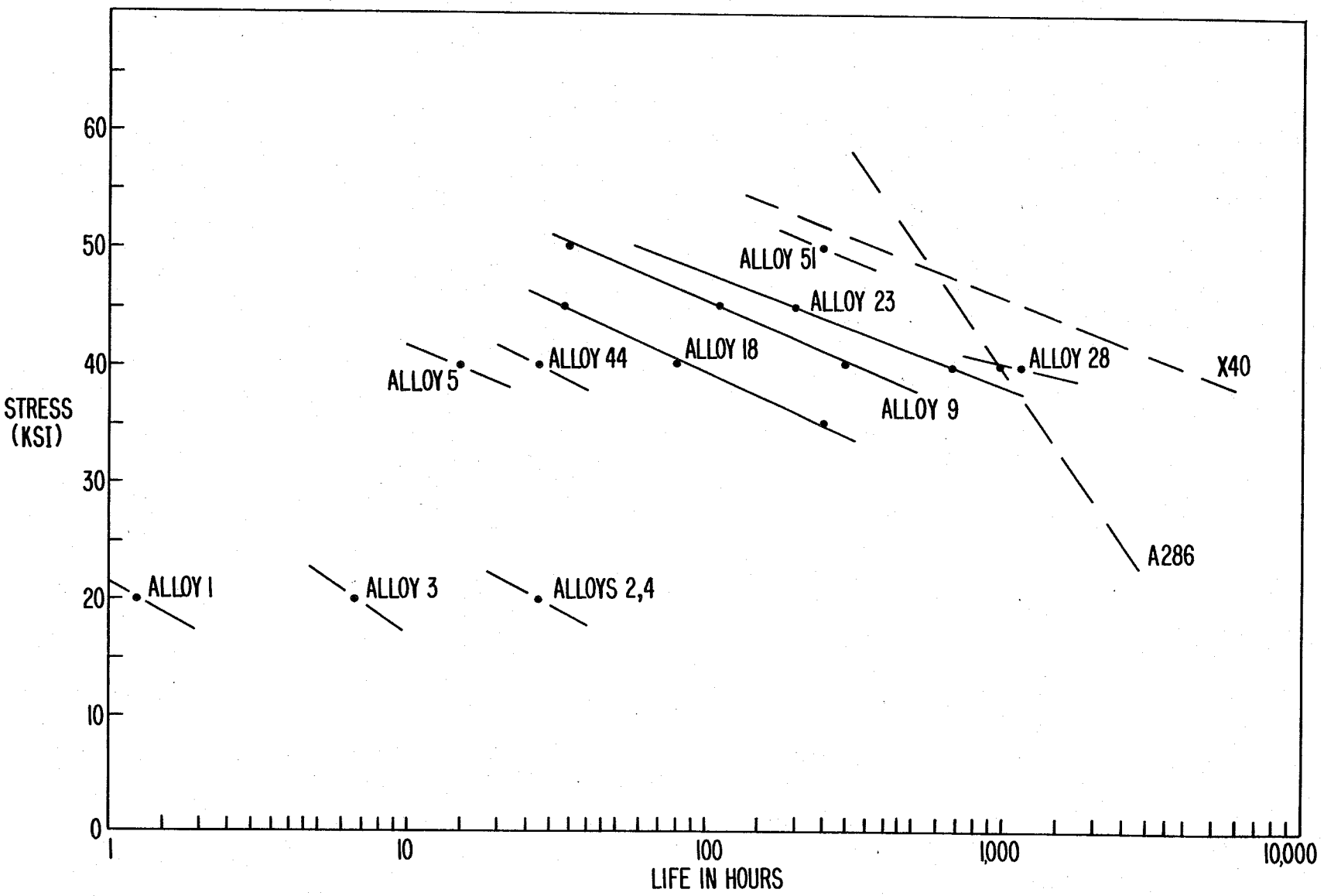
FIG. 3 is a graph of the rupture life at 1200° F. for several iron aluminum alloys.

Reference will now be made in detail to the present preferred embodiments of the invention.

In accordance with the invention, approximately 60 iron-aluminum alloy compositions were prepared where the chemistry involved major variations in aluminum (11–28%), titanium (0–8.5 w/0), molybdenum (0–10.2%), hafnium (0–1.6%), silicon (0–3.6%), and carbon (0–0.1%) as major alloying elements. The specific iron-aluminum alloy compositions prepared are listed in Table I of FIG. 1.

Initially, the compositions identified in Table I as Alloys 1 through 5 and 10 were produced. These included baseline compositions 15-Alfenol (1), Thermenol (2), and a 4% titanium addition to the iron-16% aluminum alloy approximately as reported in the early literature. These alloys were vacuum investment cast into test bars to provide representative baseline properties against which subsequently developed compositions could be measured.

Stress rupture testing was initiated at 1200° F. and 20,000 psi for these early compositions. The 16-Alfenol (1) composition survived approximately one hour before failure. Alloys 2, 3, and 4 showed improvements in life up to about 30 hours as shown in FIG. 3 and FIG. 2, Table II. The titanium strengthened alloy (5) was tested at 1200° F. and 35,000 psi and survived for approximately 30 hours. When equated to a stress level of 20,000 psi, about a 100 hour life could be anticipated for Alloy 5. The increased rupture life confirmed the beneficial effects of the ternary alloys (i.e., Fe-Al-Mo, Fe-Al-Ti) with additions examined by early investigators.

The addition of hafnium and carbon in small amounts in Alloy 3 substantially altered the microstructure with regard to grain boundary phases in a manner contributing to the increased rupture life. Tantalum additions in Alloy 4 were found to enhance properties similar to molybdenum but were not further considered as tantalum is a strategic element. The boron modified iron-aluminum alloy (10) was not rupture tested as the material was brittle at 1200° F. due to a continuous grain boundary boride phase in the as-cast condition.

Against this background, a matrix of iron-aluminum alloy compositions was produced covering the ranges of 11–17% aluminum, 0–1% hafnium, 2–8% molybdenum, and 2–8% titanium. In certain alloys including hafnium up to 0.2% carbon was added. Stress rupture testing was initiated for these compositions at 1200° F. and 40,000 psi.

Alloy 18 including modest amounts of hafnium (0.5%) and molybdenum (0.65%) added to the 4% titanium alloy yielded a rupture life of approximately 80 hours. Increasing the molybdenum and titanium contents to 4% each as in Alloy 19 yielded a rupture life of roughly 290 hours (see Table II). The addition of another 1.5% titanium as in Alloy 23 yielded a rupture life of over 660 hours.

The improvements in rupture life exhibited by additions of molybdenum and titanium led to further investigations. Alloy 28 containing approximately 8% each of molybdenum and titanium and about 0.3% hafnium produced a rupture life of over 1100 hours at 1200° F. and 40,000 psi. This rupture life is roughly the rupture life of heat resistant alloy A286 (see FIG. 3). However, rupture ductility was significantly reduced and rupture tests at higher stresses did not produce similar improvements in life. It is believed this may be due to diluting effects on the amount of aluminum present as a result of the high alloy content.

The addition of silicon to the basic iron-aluminum alloy improved rupture life comparable to equal additions of titanium. In Alloy 44 a 4% addition of silicon to the basic iron-aluminum alloy yielded a rupture life of approximately 27 hours. It is believed that this improvement results from the fact the silicon stabilize the $DO_3$ ordered structure of the alloy. $Fe_3Si$, which has a $DO_3$ structure, is isomorphous with $Fe_3Al$, but is stable to a much higher temperature.

Based on the improved rupture properties discovered, and in accordance with the invention, Alloy 51 including roughly 0.3% silicon, 0.16% carbon, 0.5% hafnium, 4% molybdenum, 4% titanium alloy, and 16% aluminum was prepared. As shown in Table II, Alloy 51 yielded a rupture life of 250 hours with improved ductility.

As currently understood, silicon and titanium are potent solid solution strengtheners, both creating a more stable $DO_3$ ordered structure, however, increased additions have been shown to reduce ductility over the range of iron aluminum alloys studied. The addition of molybdenum provides modest strengthening and increases the tolerance for titanium additions by relieving some of the misfit strain associated with the titanium. All of these alloying additions increase the temperature at which the $DO_3$ ordered crystallographic structure changes to the less desirable B2 ordered structure. Applicants have found that such increases in critical transition temperature, $T_c$, are associated with improved rupture properties. This association is demonstrated by the following measured increases in $T_c$ over unalloyed iron-16% aluminum: Alloy 19 up 301° F.; Alloy 23 up 430° F.; and Alloy 28 up 455° F. The corresponding increases in rupture properties are displayed in Table II.

While the structure based upon these additions is essentially single phase, large additions of silicon promote the presence of undesirable eutectic phases in the cast structure and are to be avoided. When the aluminum content is reduced below about 12%, a disordered alpha phase may be produced together with the ordered $Fe_3Al$ ($DO_3$) structure. This two-phase structure may be manipulated by thermal treatments to produce improved high temperature strengths. A $T_c$ increase of 491° F. was measured in Alloy 29 containing about 11% aluminum.

Higher levels of aluminum can also be expected to provide increased high temperature properties. Alloy 35 containing about 1% aluminum yielded a $T_c$ increase of more than 500° F. above that for unalloyed iron-16 aluminum. The precise increase in $T_c$ has not yet been determined.

The addition of hafnium provides a strengthening effect at high temperature by precipitating discontinuously at the grain boundaries either as a carbide when carbon is present or as an intermetallic compound combining with titanium and molybdenum. However, hafnium additions must be controlled since an insufficient amount of hafnium allows the presence of a grain boundary film leading to imbrittlement and too much hafnium dilutes the titanium and molybdenum from their roles as solid solution strengtheners in addition to causing formation of undesirable amounts of intermetallic phases. Carbon is added in small amounts to alloy with the hafnium to produce preferred carbides which free the molybdenum and titanium for their respective strengthening roles. Carbon, along with small lanthanum and other minor additions, is also provided to minimize the level of oxygen, sulfur, and other undesirable tramp elements deleterious to satisfactory engineering properties.

While initial testing of this alloy system has demonstrated the feasibility and advantages of using such compositions in high temperature applications, the full potential of the material will be determined by combining the compositions disclosed herein with appropriate forming techniques.

The present invention has been disclosed in terms of preferred embodiments. The invention is not limited thereto and is defined by the appended claims and their equivalents.

What is claimed is:

1. An iron-aluminum alloy composition consisting essentially of about 10 to about 19% aluminum; from about 2 to about 8% titanium; from about 0.5 to about 10% molybdenum; from about 0.1 to about 1% hafnium; and the balance iron.

2. An iron-aluminum alloy composition consisting essentially of from about 10 to about 19% aluminum; from about 2 to about 8% titanium; from about 0.5 to about 10% molybdenum; from about 0.1 to about 1% hafnium; and the balance iron having excellent oxidation resistance and a stress rupture life of at least 15 hours at 1200° F. and 40,000 psi.

3. An iron-aluminum alloy composition consisting essentially of from about 14 to 18% aluminum; from about 3 to about 6% titanium; from about 3 to about 6% molybdenum; from about 0.1 to about 0.8% hafnium; from about 0.01 to about 0.3% carbon; up to about 0.6% silicon; and the balance iron having excellent oxidation resistance and a stress rupture life of at least 1 hour at 1200° F. and 40,000 psi.

4. An iron-aluminum alloy composition consisting essentially of from about 10 to about 15% aluminum; from about 6 to about 12% titanium; from about 6 to about 12% molybdenum; from about 0.1 to about 0.8% hafnium; up to about 0.1% silicon; up to about 0.05% carbon; and the balance iron having excellent oxidation resistance and a stress rupture life of at least 1 hour at 1200° F. and 40,000 psi.

5. An iron-aluminum alloy composition consisting essentially of from about 10 to about 22% aluminum; from about 2 to about 12% titanium; from about 2 to about 12% molybdenum; from about 0.1 to about 1.2% hafnium; up to about 1.5% silicon; up to about 0.3% carbon; up to about 0.2% boron; up to about 1.0% tantalum; up to about 0.5% tungsten; up to about 0.5% vanadium; up to about 0.5% manganese; up to about 0.3% cobalt; up to about 0.3% columbium; up to about 0.2% lanthanum; and the balance iron having excellent oxidation resistance and a stress rupture life of at least 1 hour at 1200° F. and 40,000 psi.

6. An iron-aluminum alloy composition consisting essentially of from about 15 to about 22% aluminum; from about 3 to about 12% titanium; from about 3 to about 12% molybdenum; from about 0.1 to about 0.8% hafnium; up to about 0.1% silicon; up to about 0.05% carbon; and the balance iron having excellent oxidation resistance and a stress rupture life of at least 1 hour at 1200° F. and 40,000 psi.

* * * * *